US005233657A

United States Patent [19]

Günther

[11] Patent Number: 5,233,657

[45] Date of Patent: Aug. 3, 1993

[54] METHOD FOR FRANKING POSTAL MATTER AND DEVICE FOR CARRYING OUT THE METHOD

[75] Inventor: Stephan Günther, Berlin, Fed. Rep. of Germany

[73] Assignee: Francotyp-Postalia GmbH, Berlin, Fed. Rep. of Germany

[21] Appl. No.: 782,566

[22] Filed: Oct. 25, 1991

[30] Foreign Application Priority Data

Oct. 25, 1990 [DE] Fed. Rep. of Germany ..... 4034292

[51] Int. Cl.[5] ..... H04K 1/00

[52] U.S. Cl. ..... 380/23; 380/18; 380/51; 380/55; 364/469.02

[58] Field of Search ..... 380/18, 23, 24, 25, 380/51, 55; 364/464.02, 464.03; 235/101, 432

[56] References Cited

U.S. PATENT DOCUMENTS

| | | | |
|---|---|---|---|
| 4,253,158 | 2/1981 | McFiggans | 380/23 X |
| 4,757,329 | 7/1988 | Sato et al. | 235/432 X |
| 4,775,246 | 10/1988 | Edelmann et al. | 380/23 |
| 4,858,138 | 8/1989 | Talmadge | 364/464.02 |
| 4,933,849 | 6/1990 | Connell et al. | 364/464.02 X |
| 4,999,481 | 3/1991 | Baer et al. | 364/464.02 X |

*Primary Examiner*—Tod R. Swann

*Attorney, Agent, or Firm*—Herbert L. Lerner; Laurence A. Greenberg

[57] ABSTRACT

A method for franking postal matter uses an apparatus of a postage user having franking functions and being coupled through telecommunication devices with a remote data processing center for recording and releasing postage. A terminal device of a telecommunication system installed at a location of a user is coupled with a data processing center associated with a postage service for settling postage through telecommunications connections. Data is transmitted to the data processing center in one direction for requesting a central recordation of postage and for generating franking data. At least essential portions of a franking image corresponding to the requested franking are transmitted in another direction. The franking image is completed in the terminal device with stored image portions. A device for franking postal matter includes a terminal device of a postage user. The terminal device performs franking functions. A two-way telecommunication input device couples the terminal device with a remote data processing center for recording and releasing postage. The terminal device has a printer, a coding device for securing the two-way communication with cryptographic encoding, and a safety device for preventing counterfeiting of a franking imprint.

15 Claims, 3 Drawing Sheets

Fig.1
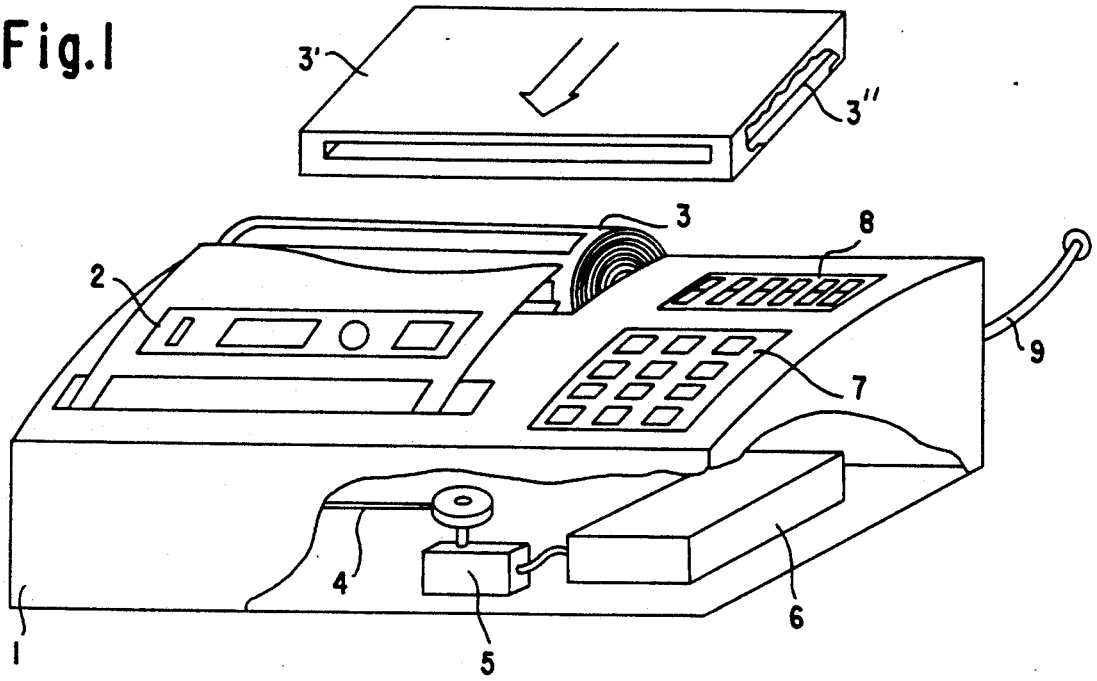
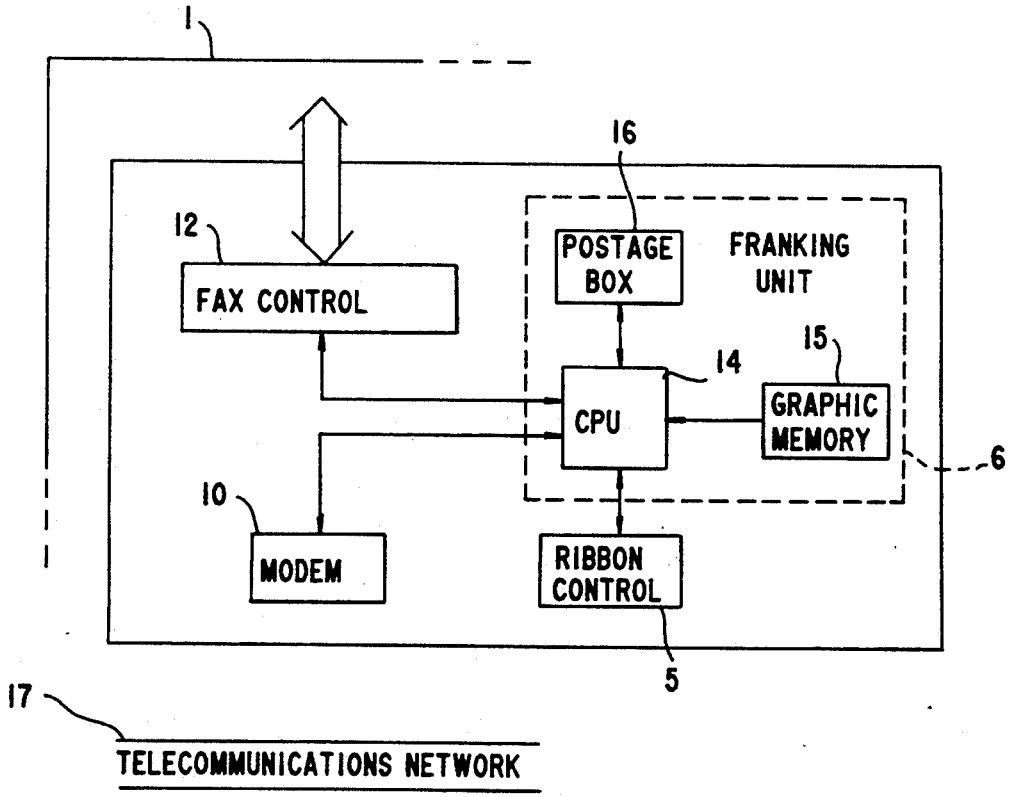
Fig.2

METHOD FOR FRANKING POSTAL MATTER AND DEVICE FOR CARRYING OUT THE METHOD

The invention relates to a method for franking postal matter and a device for carrying out the method, wherein an apparatus of a user provided with franking functions is coupled through telecommunication devices with a remote central data processing installation for recording postage.

The cooperation of postage meters with data processing installations for the central settlement of postage charges by using available communications networks is known, such as from German Published, Non-Prosecuted Applications DE-28 20 658 A1; DE-31 26 785 A1; and DE-31 26 786 A1. Such devices are used for requesting credits to be loaded into a postage meter. In such a case an authorization as well as an identification of the postage meter are checked by means of a calculating mode and control combinations.

Postage meters are among the more valuable industrial equipment due to their initial cost and maintenance and for that reason are unprofitable for businesses with medium or small postage requirements.

It is accordingly an object of the invention to provide a method for franking postal matter and a device for carrying out the method, which overcome the hereinafore-mentioned disadvantages of the heretofore-known methods and devices of this general type, and which provide a franking possibility that is profitable for small and medium postage requirements by using devices present at the location of the user which indicate the central settlement of the postage used, without additional installations for a remote crediting operation at the user's location.

With the foregoing and other objects in view there is provided, in accordance with the invention, a method for franking postal matter with an apparatus of a postage user having franking functions and being coupled through telecommunication devices with a remote data processing center for recording postage used and releasing postage, which comprises coupling a terminal device of a telecommunication system installed at a location of a user with a data processing center associated with a postage service for settlement of postage used through telecommunications connections, transmitting data to the data processing center in one direction for requesting a central recordation of postage used and for generating franking data, transmitting at least essential portions of a franking image corresponding to the requested franking in another direction, and completing the franking image in the terminal device with stored image portions.

The method is based on the utilization of a telecommunication system with various terminal devices which are connected with a central data processing installation for the accounting of postage expenses.

In accordance with another mode of the invention, there is provided a method which comprises storing permanent image portions of the franking image in nonvolatile memories in the terminal device.

In accordance with another mode of the invention, there is provided a method which comprises safeguarding the data transmission between the terminal device and the data processing center with cryptographic encoding.

In accordance with another mode of the invention, there is provided a method which comprises settling postage charges of individual frankings in a secure postage box of the terminal device and communicating between the data processing center and the postage box for settling the postage used and replenishing an account.

With the objects of the invention in view, there is also provided a device for franking postal matter, comprising a terminal device of a postage user having means for performing franking functions, a two-way telecommunication input device for coupling the terminal device with a remote data processing center for recording postage used and releasing postage, a printer, a coding device for securing the two-way communication with cryptographic encoding, and safety means for preventing counterfeiting of a franking imprint.

In accordance with another feature of the invention, the safety means include a special ribbon used exclusively for the franking imprint, and a postage box for releasing the special ribbon only after settlement of printed postage used.

In accordance with a further feature of the invention, there are provided means associated with the coding device for generating a security code from data identifying the terminal device to be printed out by the printer together with the franking data.

In accordance with an added feature of the invention, there are provided means for supplying the printer with strips for printing the postage.

In accordance with an additional feature of the invention, the strips are unseparated, self-sticking labels.

In accordance with yet another feature of the invention, there is provided a strip dispenser and a feed device for separately supplying the strips to the printer.

In accordance with yet a further feature of the invention, the terminal device is a remote copier for telefax service.

In accordance with a concomitant feature of the invention, the terminal device is a multi-functional terminal device of the integrated service data net (ISDN).

Other features which are considered as characteristic for the invention are set forth in the appended claims.

Although the invention is illustrated and described herein as embodied in a method for franking postal matter and a device for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a diagrammatic, partly broken-away, perspective view of a remote copier with a franking unit;

FIG. 2 is a block circuit diagram of the remote copier and a telecommunications network;

Figure 3:
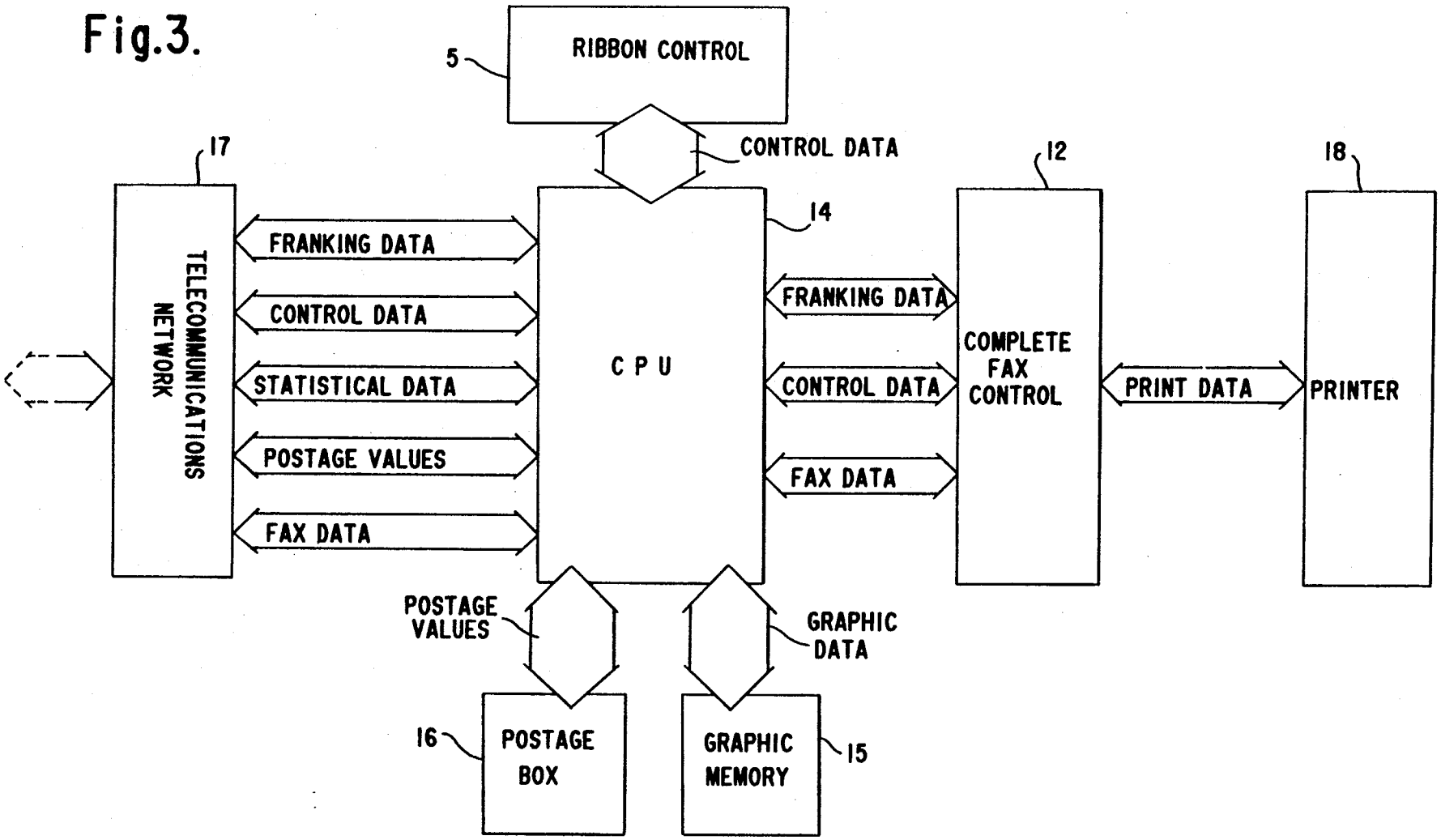
FIG. 3 is an information flow chart for the method.

Referring now to the figures of the drawing in detail and first, particularly, to FIG. 1 thereof, there is seen a remote copier 1 containing a franking unit 6. An existing keyboard 7 is also used for an input of an amount of postage. The particular mode of the postage meter is shown on a display 8. In addition, the display is reset so as to show amounts of postage and other postage-related data, such as accounting data. A ribbon control 5, which is controlled by the franking unit 6, controls or monitors a special ribbon 4. A roll 3 of unprinted franking strips is connected with a paper feed of the remote copier. As an alternative, it is possible to use a strip dispenser 3' with a feed device 3'' at the illustrated location of the roll 3. Completed franking strips 2 are removed from the normal output of the remote copier.

If a remote copier for telefax operations is a terminal device used as a postage printing device, it is further necessary to assign to it the input device which is in the form of the keyboard 7 and the display 8 for communication with a data processing center. The control of the data flow between the franking unit 6 on one hand and the operating surface and the printer on the other hand is performed by a remote copier or fax control 12 shown in FIG. 2. A coding installation for cryptographic encoding and security means for preventing counterfeiting of the printed postage are provided.

In particular, as a safety measure the special or additional ribbon 4 may have a color which is visibly different from other colors that can be printed out by the remote copier. This ribbon is only released for printing after a settlement or payment of the postage used in the particular printing has taken place, for example by means of a postage box 16.

A terminal device which is present at a user's location, such as the remote copier in the example given above, is connected by means of a telecommunications connection 9, 17 through a modem 10 shown in FIG. 2, with a data processing center connected with this service. A microprocessor 14 triggers and monitors a control of the franking unit 6 and a resetting of the remote copier control 12. Requests of the user for the central settlement or payment of postage used and for generating franking data are transmitted to the data processing center through this connection. A franking image and/or essential parts thereof corresponding to the franking request are transmitted in the opposite direction from the data processing center to the terminal device or are released in order to make it possible for the terminal device to print the complete franking image.

For reasons of security it is advantageous to store a portion of the franking image in the terminal device and to forward the other portion to the terminal device from the data processing center. Both portions are combined in the terminal device into the final franking image. The permanent portions of the franking image, such as the advertising field of the user and, if desired, the framing configuration of the value print-out with address, ZIP code and date, are preferably stored in a graphics memory 15 of the terminal device 1 of the user. A non-volatile memory is used as storage means for the permanent data of the franking image.

Communications between the terminal device in its function as a postage-printing device and the data processing center are made secure by means of cryptographic encoding, for example in accordance with the known RSA data encoding method.

The secure postage box 16 is assigned to the terminal device for settlement or payment of postage used in the individual franking operations. In the course of each credit request of the user, the postage box 16 is queried and checked by the data processing center through the communications link. The credit amount in the postage box 16 is replenished or loaded in and the portion of the franking image which is monitored by the data processing center is released only after certain preset conditions have been met.

A security code is generated and printed together with the franking data as a further security measure. This security code is composed of data which identify the terminal device.

The flow of information for the franking unit 6 in accordance with the block diagram of FIG. 2 is shown in FIG. 3, which merely indicates the flow of data described above.

Figure 4:
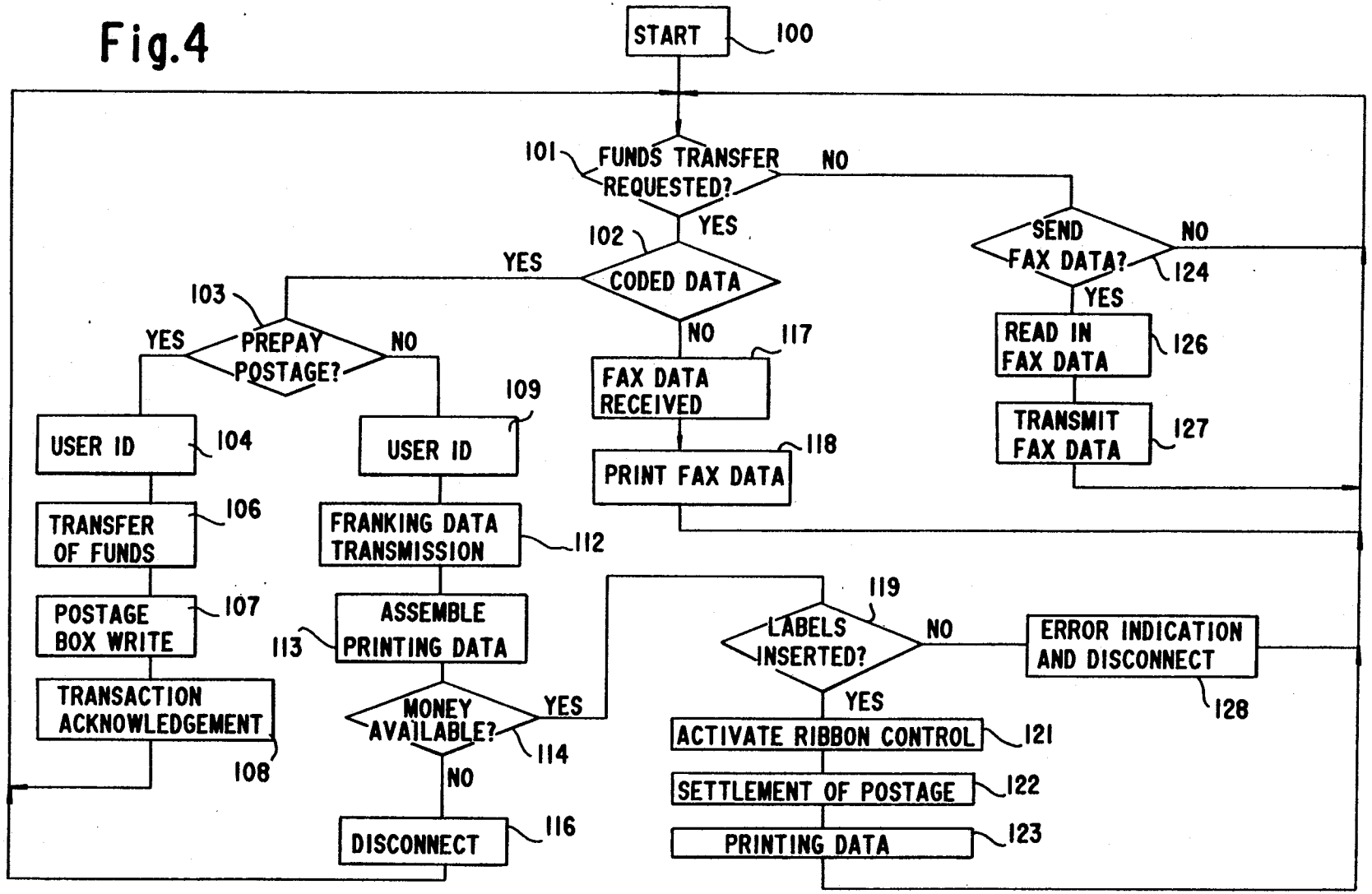
FIG. 4 is a flow chart of a franking unit of the remote copier in accordance with FIG. 1.

A typical flow chart for a remote copier with a franking capability of this type is shown in FIG. 4.

The franking or printing of the postage on strips 2 is performed by means of a control of a printer or print head 18 through resetting of the remote copier or fax control 12. Before the strips 2, which may be self-sticking labels, are completed, they are located on the unprinted roll 3 which is placed on a print roller of the remote copier without separating the strips 2 for printing. A strip dispenser is provided as a further variant for supplying the strips 2 individually to the print roller by means of a feed device.

A communication service implemented in the terminal device is used if a multi-functional ISDN terminal device with a printing mechanism is used. The security measures correspond to the measures previously described in connection with a remote copier.

FIG. 4 shows the operation of the invention in flow chart form. After a Start (100), an inquiry is made in a step 101 to determine if a funds (i.e. frankage) transfer transaction is requested. If the answer is "Yes", an inquiry is made in a step 102 to determine if the data are to be encoded (i.e. in a secret code). If the answer is "Yes", an inquiry is made in a step 103 to determine if postage has been prepaid. If the answer is "Yes", a user identity is sent to the data center in a step 104, followed by a transfer of funds in a step 106. Next the corresponding amount is entered into the postage box in a step 107, followed by transaction acknowledgement in a step 108, after which the funds transfer process is completed, and the franking device returns to the start state in the step (100).

In case the determination in the step 103 is "No", again the user identity is transmitted to the data center in a step 109, followed by transmission of franking data in a step 112, again followed by the assembly of the printing data in a step 113, after which an inquiry is made in a step 114 to determine if funds for the franking amount are available. If the answer is "No", the transaction is terminated in step 116 followed by a return to "Start" 100), but if the answer is "Yes", an inquiry is made in a decision step 119 to determine if labels have been inserted. If the answer is "Yes", the ink ribbon control is activated in a step 121, followed by a settlement of the postage in a step 122, and the printing data are printed in a step 123, followed by a return to "Start" (100). If the answer is "No", i.e. the labels have not been inserted, an error indication takes place in a step 128 and the franking device returns to the "Start" state in the step (100).

In case the answer in the step 102 is "No", the fax data are received from the data center in a step 117, followed by printing of the fax data in a step 118, after which the franking transaction is completed, and the franking device returns to the "Start" state in the step (100).

In case the answer to the inquiry in the step 101 is "No", i.e. a transfer of frankage is not required, an inquiry is made in a step 124 to determine if fax data could be sent. If the answer is "Yes", fax data will be entered in a step 126, and transmitted to the franking device in a step 127, after which the franking operation is completed, and the device is returned to the "Start" state in the step (100).

In case the answer in the step 124, as to whether or not fax data can be sent, is "No", the device will return to the "Start" state (100).

In case the answer to the inquiry in step 119 is "No", i.e. no labels are inserted, an error indication followed by a disconnect is made in step 128, after which the device will return to "Start" (100).

I claim:

1. A method for franking postal matter with an apparatus of a postage user having franking functions and being coupled through telecommunication devices with a remote data processing center for recording and releasing postage, which comprises:

storing permanent image portions of a franking image in a non-volatile memory associated with a remote copier for telefax service installed at a location of a user;

coupling the remote copier through a telecommunication system with a data processing center associated with a postage service for settlement of postage through telecommunications connections, transmitting data to the data processing center in one direction for requesting a central recordation of postage and for generating franking data, transmitting at least essential portions of a franking image corresponding to the requested franking in another direction, and completing the franking image in the terminal device with stored image portions.

2. The method according to claim 1, which comprises safe-guarding the data transmission between the terminal device and the data processing center with cryptographic encoding.

3. The method according to claim 1, which comprises settling postage of individual frankings in a secure postage box of the terminal device and communicating between the data processing center and the postage box for settling the postage and replenishing an account.

4. A device for franking postal matter, comprising a remote copier for telefax service of a postage user having:

means for performing franking functions;

means for storing permanent image portions of a franking image, a two-way telecommunication input device for coupling said terminal device with a remote data processing center for recording and releasing postage, a printer, a coding device for securing the two-way communication with cryptographic encoding, means for combining information received from the remote data processing center with the stored permanent image portions to form a final franking image, and safety means for preventing counterfeiting of a franking imprint.

5. The device according to claim 4, wherein said safety means include a special ribbon used exclusively for the franking imprint, and a postage box for releasing said special ribbon only after settlement of printed postage.

6. The device according to claim 5, including means associated with said coding device for generating a security code from data identifying said terminal device to be printed out by said printer together with the franking data.

7. The device according to claim 4, including means for supplying said printer with strips for printing the postage.

8. The device according to claim 7, wherein said strips are unseparated, self-sticking labels.

9. The device according to claim 7, including a strip dispenser and feed device for separately supplying said strips to said printer.

10. A device for franking postal matter, comprising a multi-functional integrated service data network of a postage user having:

means for performing franking functions;

means for storing permanent image portions of a franking image, a two-way telecommunication input device for coupling said terminal device with a remote data processing center for recording and releasing postage, a printer, a coding device for securing the two-way communication with cryptographic encoding, means for combining information received from the remove data processing center with the stored permanent image portions to form a final franking image, and safety means for preventing counterfeiting of a franking imprint.

11. The device according to claim 10, wherein said safety means include a special ribbon used exclusively for the franking imprint, and a postage box for releasing said special ribbon only after settlement of printed postage.

12. The device according to claim 11, including means associated with said coding device for generating a security code from data identifying said terminal device to be printed out by said printer together with the franking data.

13. The device according to claim 10, including means for supplying said printer with strips for printing the postage.

14. The device according to claim 13, wherein said strips are unseparated, self-sticking labels.

15. The device according to claim 13, including a strip dispenser and a feed device for separately supplying said strips to said printer.

* * * * *